US010845170B2

(12) United States Patent
Morris

(10) Patent No.: US 10,845,170 B2
(45) **Date of Patent: *Nov. 24, 2020**

(54) MORRIS 80 PLASTIC TOUR BOLT

(71) Applicant: Elgie Allen Morris, Grants Pass, OR (US)

(72) Inventor: Elgie Allen Morris, Grants Pass, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/299,353

(22) Filed: Mar. 12, 2019

(65) Prior Publication Data

US 2020/0292284 A1 Sep. 17, 2020

(51) Int. Cl.
*F42B 6/06* (2006.01)
*F42B 10/04* (2006.01)
*F42B 6/04* (2006.01)

(52) U.S. Cl.
CPC ..... *F42B 6/06* (2013.01); *F42B 6/04* (2013.01); *F42B 10/04* (2013.01)

(58) Field of Classification Search
CPC ..... F42B 6/04; F42B 6/06; F42B 6/08
See application file for complete search history.

(56) References Cited

U.S. PATENT DOCUMENTS 3,031,797 A * 5/1962 Gelfand ..... A63H 27/14 446/65
3,106,400 A * 10/1963 Zwickey ..... F42B 6/06 473/586
3,756,602 A * 9/1973 Carella ..... F42B 6/06 473/586
3,846,878 A * 11/1974 Monson ..... F42B 6/04 86/51
3,851,590 A * 12/1974 LaCosta ..... F42B 6/04 102/501
3,853,320 A * 12/1974 Carella ..... F42B 6/06 473/586

(Continued)

*Primary Examiner* — John A Ricci

(57) ABSTRACT

When combined with a metal point, this ten inch plastic pistol crossbow bolt is designed to extend past the barrel of a pistol crossbow so it can be used for recreational shooting, competition shooting, small game hunting, pistol crossbow fishing and pistol crossbow scuba fishing. The main fault of the standard pistol crossbow bolt is they are less than seven inches in length and do not extend past the end of a pistol crossbow barrel. Therefore, their use is limited to target points and recreational shooting only. Other faults of the standard short pistol crossbow bolts are their high travel speed. They are very difficult to be viewed in flight, causing most bolts to be lost after one use. Also, their irretrievability from any commonly used target. Therefore, they cannot be found and scored in any type of shooting competition. This ten inch bolt is a solid one piece unit made of a strong but, light weight plastic compound. It has a NOCK to securely hold the bow string in place. Most bolts do not have a nock. it has two FLAT WINGS for elevation stabilizing which creates an accurate and stable bolt flight. No other bolt has this type of flat wings. These features allow this bolt to be easily viewed in flight. This also allows this bolt to be used for competition shooting because these bolts can be easily located, scored and then retrieved from any type competition target. The shaft has a THREADED TIP to accept almost any type metal point.

1 Claim, 6 Drawing Sheets

(56) References Cited

U.S. PATENT DOCUMENTS

| | | | | |
|---|---|---|---|---|
| 3,861,314 | A * | 1/1975 | Barr | F42B 6/04 102/501 |
| 4,003,576 | A * | 1/1977 | Carella | F42B 6/06 473/586 |
| 4,182,513 | A * | 1/1980 | Henderson | F42B 6/04 124/24.1 |
| 4,696,281 | A * | 9/1987 | Nishioka | F42B 6/00 124/25 |
| 6,695,727 | B1 * | 2/2004 | Kuhn | F42B 6/06 473/586 |
| 8,157,680 | B2 * | 4/2012 | Anderson | F42B 6/04 473/578 |
| 8,764,589 | B1 * | 7/2014 | Thompson | F42B 6/04 473/578 |
| 10,209,043 | B2 * | 2/2019 | Morris | F42B 6/06 |
| 2013/0123051 | A1 * | 5/2013 | Pierce | F42B 6/08 473/577 |

* cited by examiner

MORRIS 80 PLASTIC TOUR BOLT

RELATED APPLICATIONS

Provisional Application # 62/404,593
Filing Date: Oct. 5, 2016

STATEMENT REGARDED FEDERALLY SPONSORED RESEARCH

Not Applicable

NAMES OF PARTIES IN JOINT RESEARCH AGREEMENT

Not Applicable

INCORPORATION BY REFERENCE OF MATERIAL

Not Applicable

STATEMENT REGARDING PRIOR DISCLOSURES BY INVENTOR OR JOINT INVENTOR

Not Applicable

BACKGROUND

This plastic pistol crossbow bolt is made for the fifty to eighty pound pistol crossbows. It is nine and one quarter inches in length with a threaded tip to receive a metal point. Total length of this bolt will depend on the length of any metal point used. This new bolt solves many problems often found with the restricted uses of the bolts commonly used with pistol crossbows. The commonly used pistol crossbow bolts are about six inches in length. Those short bolts cause lack of visibility during flight, difficulty in locating upon impact and irretrievability of those short bolts after impact into any standard target. For that reason, those short pistol crossbow bolts cannot be used for any tournament competition, small game hunting, pistol crossbow fishing or pistol crossbow scuba fishing. The MORRIS 80 PLASTIC TOUR BOLT solves those problems. Any pistol crossbow bolts, made of metal and designed with sufficient length to solve some of the above stated problems, require some type of fetches be attached to those bolts for stability during flight. During use, those fletches often becomes loosened and requires constant reattachment and repair. That becomes is a major problem with the metal pistol crossbow bolts. The MORRIS 80 PLASTIC TOUR BOLT is a one piece solid plastic unit including two wings to stabilize flight elevation. it does not require added fletches be glued into place or continued reattachment of fletches.

SUMMARY

A plastic pistol crossbow bolt created by injection mold. Bolt composition is durable plastic with nylon reinforcement. Bolt is nine and one quarter inches in length. Bolt is designed with two wings to stabilize bolt elevation. Bolt has a threaded tip designed to extend past the barrel end and, use a variety of metal points included target, hunting, fishing and field points. No other pistol crossbow bolt is designed with two wings of this design or, uses this variety of points. This plastic pistol crossbow bolt, with its extended length, unique design and versatility in point usage, is designed to totally change and enhance the way any pistol crossbow is used.

DETAILED DESCRIPTION OF THE INVENTION

Figure 1:
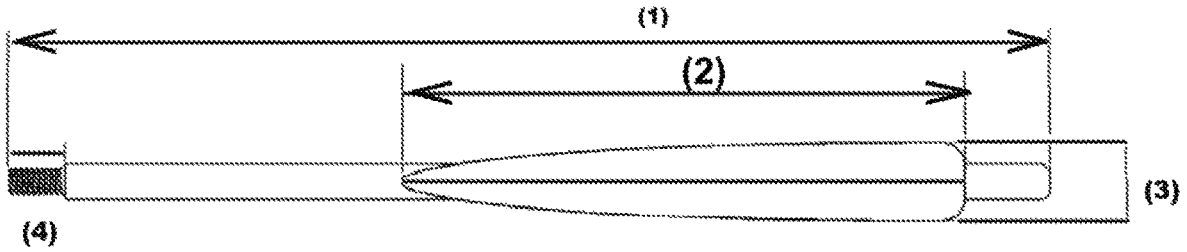
FIG. 1 shows the pistol crossbow bolt of the present invention viewed from above.
Figure 2:
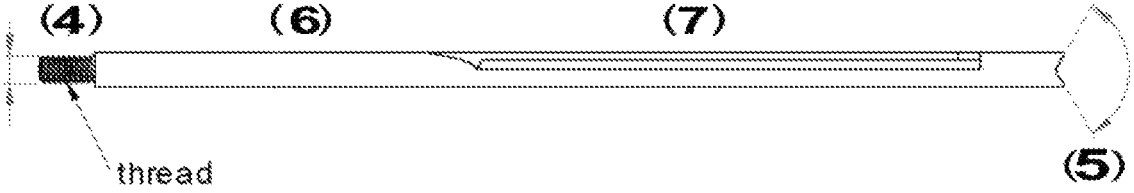
FIG. 2 shows the pistol crossbow bolt of the present invention viewed from side.
Figure 3:
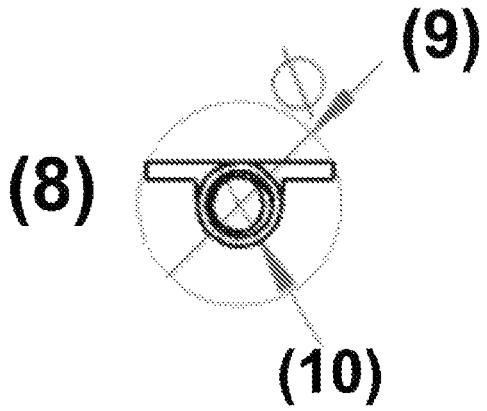
FIG. 3 shows the pistol crossbow bolt of the present invention viewed from tip end.
Figure 4:
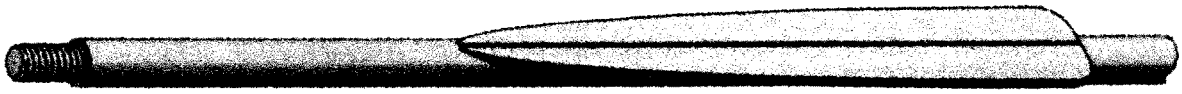
FIG. 4 shows a three dimensional view of the pistol crossbow bolt of the present invention.
Figure 5:
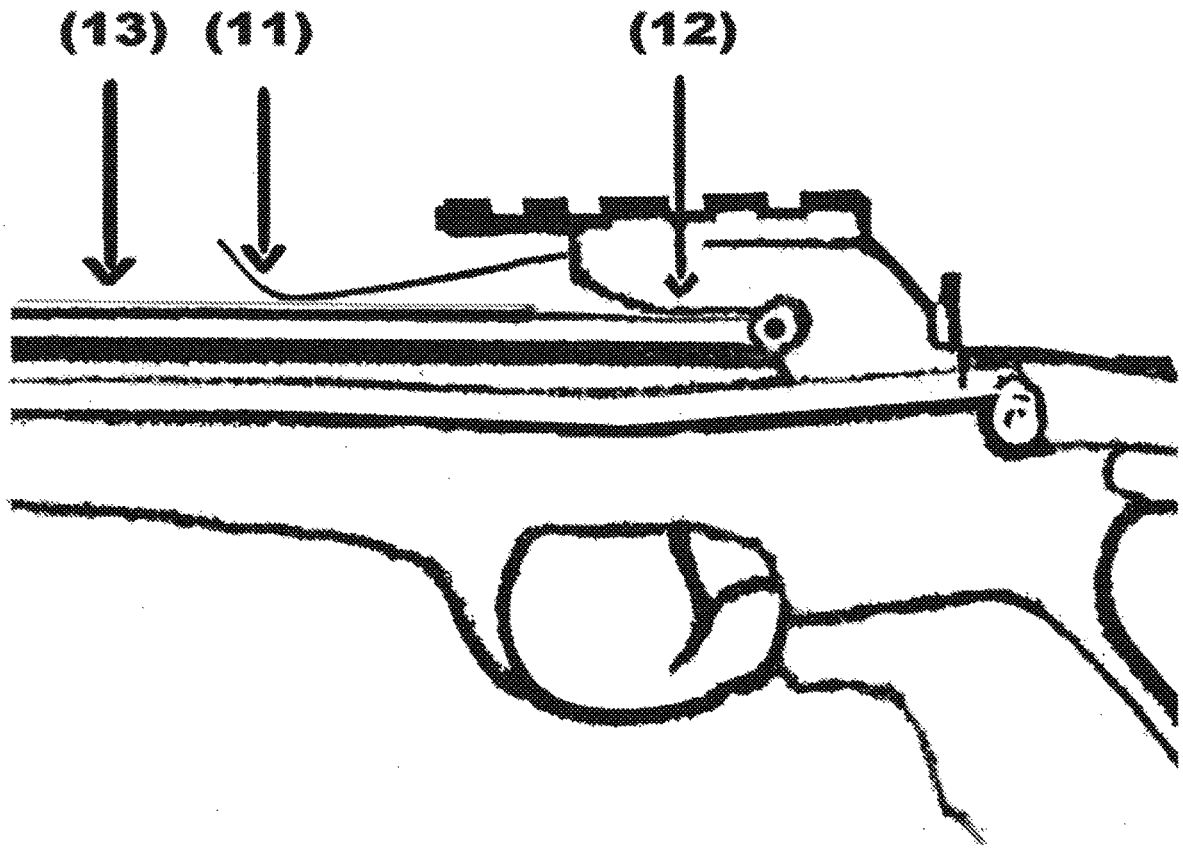
PRIOR ART FIGURE 5
FIG. 5 shows the bolt mounted on the barrel and inserted in a non-standard pistol cross bow.
Figure 6:
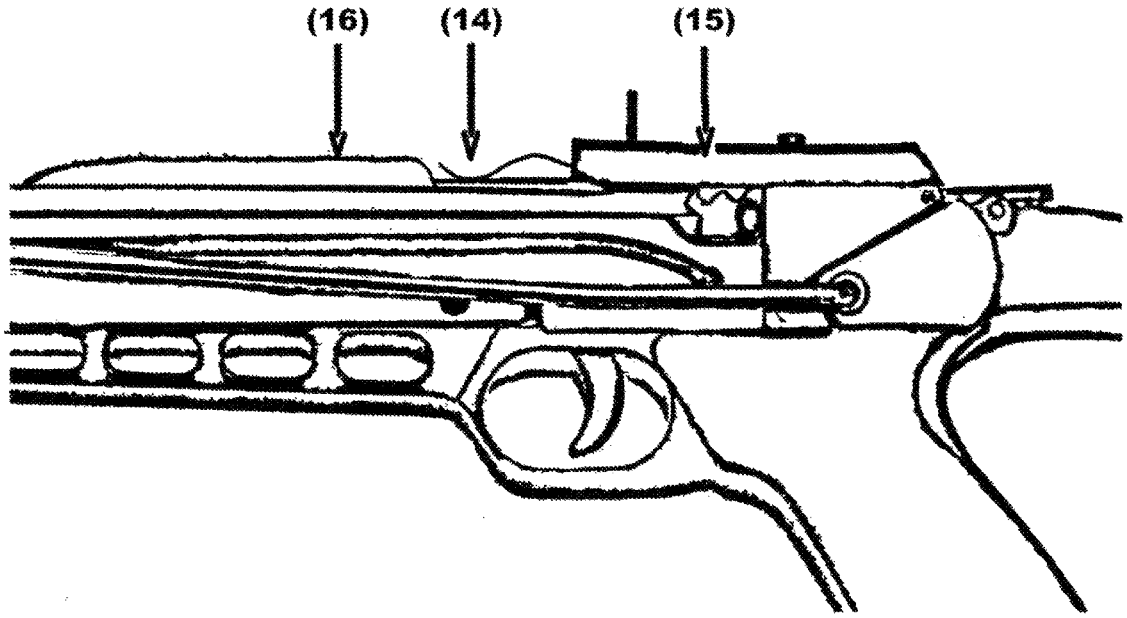
PRIOR ART FIGURE 6
FIG. 6 shows a standard bolt mounted in a standard pistol crossbow with short retention spring.

FIG. 1 shows the pistol crossbow bolt (1) is nine and one quarter inches in length. The bolt is a solid durable light weight plastic with nylon reinforcement. Each wing (2) is tapered from five-sixteenths of an inch width down to approximately one-sixteenth of an inch width starting three-quarters of an inch from the nook end. In FIG. 2, bolt includes a nock (5), two flat wings (7), a shaft (6) and a threaded tip (4) to receive a variety of metal points. This bolt, when fitted with a metal point, is designed to reach or extend past the end of any pistol crossbow barrel. FIG. 3 shows each wing (8) is one-sixteenth of an inch thick. Each of the two side wings (9) are flat and level with the top of the shaft. The bolt shaft (10) is five-sixteenths of an inch in diameter and is dowel shaped. As shown in FIG. 5, this pistol crossbow bolt is designed to be used with non-standard pistol crossbows which uses the extended retention spring limb (11) which requires a smooth top surface (13) for positioning the bolt into the non-standard pistol crossbow chamber (12). FIG. 6 shows a standard pistol crossbow bolt which does not have a smooth top Surface (16) and a standard pistol crossbow with the standard short retention spring (14) allowing this bolt to enter the chamber (15).

The invention claimed is:

1. A plastic pistol crossbow bolt designed for use with a non-standard pistol crossbow that uses an extended retention spring limb, having a barrel, comprising: a shaft comprising a solid one piece injection molded plastic unit having a length of approximately nine and one half inches with a nock on a first end which is configured to securely hold a string of a pistol crossbow; two flat wings level with an upper surface of the shaft to control elevation during bolt flight; and a threaded end piece on a second end configured to accommodate a variety of metal points.

* * * * *